US009630762B2

(12) United States Patent
Minnette

(10) Patent No.: US 9,630,762 B2
(45) Date of Patent: Apr. 25, 2017

(54) PACKAGE WITH PEELABLE CLOSURE

(71) Applicant: Berry Plastics Corporation, Evansville, IN (US)

(72) Inventor: Jeffrey C Minnette, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/603,083

(22) Filed: Jan. 22, 2015

(65) Prior Publication Data

US 2015/0203263 A1 Jul. 23, 2015

Related U.S. Application Data

(60) Provisional application No. 61/930,076, filed on Jan. 22, 2014.

(51) Int. Cl.

| | |
|---|---|
| ***B65D 53/02*** | (2006.01) |
| ***B65D 43/26*** | (2006.01) |
| ***B65D 41/32*** | (2006.01) |
| ***B65D 77/20*** | (2006.01) |
| ***B65D 43/02*** | (2006.01) |

(52) U.S. Cl.

CPC ..... *B65D 77/2032* (2013.01); *B65D 43/0256* (2013.01); *B65D 77/2036* (2013.01); *B65D 77/2072* (2013.01); *B65D 2543/00296* (2013.01)

(58) Field of Classification Search

CPC ..... B65D 53/02; B65D 41/32; B65D 43/26; B65D 77/2032; B65D 77/2072; B65D 77/2036; B65D 77/2088; B65D 43/02; B65D 43/0256; B65D 43/0262; B65D 2543/00092; B65D 2543/00083; B65D 2543/0024; B65D 2543/00231; B65D 2543/00296; B65D 2543/0037

See application file for complete search history.

(56) References Cited

U.S. PATENT DOCUMENTS

| | | | |
|---|---|---|---|
| 2,614,727 | A | 10/1952 | Robinson |
| 2,772,013 | A | 11/1956 | Stover |
| 2,901,140 | A | 8/1959 | Robinson |
| 3,102,182 | A | 8/1963 | Oelze Heinz |
| 3,276,616 | A | 10/1966 | Lurie |
| 3,521,422 | A | 7/1970 | Tabor |
| 3,679,509 | A | 7/1972 | Fielibert |

(Continued)

FOREIGN PATENT DOCUMENTS

| | | | |
|---|---|---|---|
| CH | 652965 | A5 | 12/1985 |
| DE | 1232873 | B | 1/1967 |

(Continued)

OTHER PUBLICATIONS

PCT International Search Report and Written Opinion completed by the ISA/US on Mar. 19, 2015 and issued in connection with PCT/US2015/012497.

(Continued)

*Primary Examiner* — Andrew Perreault

(74) *Attorney, Agent, or Firm* — Barnes & Thornburg LLP

(57) ABSTRACT

A package includes a container and a closure for mating on the brim of the container. The closure is hermetically sealed to the container brim at a factory. The seal is broken the first time a consumer removes the closure from the container brim.

8 Claims, 12 Drawing Sheets

(56) References Cited

U.S. PATENT DOCUMENTS

| | | | | |
|---|---|---|---|---|
| 3,834,606 | A | 9/1974 | Anderson | |
| 3,913,785 | A | 10/1975 | Pattershall | |
| 3,934,749 | A | 1/1976 | Andrulionis | |
| 3,938,686 | A | 2/1976 | Milligan | |
| 3,956,550 | A | 5/1976 | Sutch | |
| 4,044,941 | A | 8/1977 | Knudsen | |
| 4,109,815 | A | 8/1978 | Collins, III | |
| 4,111,330 | A | 9/1978 | Jordan | |
| 4,141,463 | A | 2/1979 | Smith | |
| 4,171,084 | A | 10/1979 | Smith | |
| 4,192,434 | A | 3/1980 | Conroy | |
| 4,209,107 | A | 6/1980 | Crisci | |
| 4,215,797 | A | 8/1980 | Chen | |
| 4,238,047 | A | 12/1980 | Helms | |
| 4,252,248 | A | 2/1981 | Obrist | |
| 4,258,529 | A | 3/1981 | Smith | |
| 4,333,585 | A | 6/1982 | Del Bon | |
| 4,349,119 | A | 9/1982 | Letica | |
| 4,356,930 | A | 11/1982 | Roper | |
| 4,397,133 | A | 8/1983 | Hume | |
| 4,418,834 | A | 12/1983 | Helms | |
| 4,438,864 | A | 3/1984 | Helms | |
| 4,442,971 | A | 4/1984 | Helms | |
| 4,448,345 | A | 5/1984 | Helms | |
| 4,495,749 | A | 1/1985 | Faller | |
| 4,533,063 | A | 8/1985 | Buchner | |
| 4,595,117 | A | 6/1986 | Walter | |
| 4,685,273 | A | 8/1987 | Caner | |
| 4,692,132 | A | 9/1987 | Ikushima | |
| 4,738,374 | A | 4/1988 | Ingemann | |
| 4,775,076 | A | 10/1988 | Horvath | |
| 4,838,008 | A | 6/1989 | Hardy | |
| 4,888,935 | A | 12/1989 | Wythoff | |
| 5,015,313 | A | 5/1991 | Drew | |
| 5,032,213 | A | 7/1991 | Thomas | |
| 5,039,001 | A | 8/1991 | Kinigakis | |
| 5,091,231 | A | 2/1992 | Parkinson | |
| 5,097,107 | A | 3/1992 | Watkins et al. | |
| 5,098,751 | A * | 3/1992 | Tamura | B32B 15/08 229/125.35 |
| 5,174,460 | A | 12/1992 | Minnette | |
| 5,178,297 | A | 1/1993 | Harold | |
| 5,246,134 | A | 9/1993 | Roth | |
| 5,248,134 | A | 9/1993 | Ferguson | |
| 5,258,191 | A | 11/1993 | Hayes | |
| 5,316,603 | A | 5/1994 | Akazawa | |
| 5,377,873 | A | 1/1995 | Minnette | |
| 5,385,255 | A | 1/1995 | Varano | |
| 5,395,005 | A | 3/1995 | Yoshida | |
| 5,428,209 | A | 6/1995 | Babu et al. | |
| 5,443,853 | A | 8/1995 | Hayes | |
| 5,511,679 | A | 4/1996 | Beck | |
| 5,634,567 | A | 6/1997 | Hekal | |
| 5,647,501 | A | 7/1997 | Helms | |
| 5,692,635 | A | 12/1997 | Farrell | |
| 5,810,197 | A | 9/1998 | Mazzarolo | |
| 5,911,334 | A | 6/1999 | Helms | |
| 5,947,278 | A | 9/1999 | Sawhney | |
| 5,950,861 | A | 9/1999 | Roth | |
| 5,983,607 | A | 11/1999 | Mihalov | |
| 6,032,823 | A | 3/2000 | Bacon | |
| 6,053,353 | A | 4/2000 | Helms | |
| 6,145,689 | A | 11/2000 | Kobayashi | |
| 6,196,451 | B1 | 3/2001 | Helms | |
| 6,234,386 | B1 | 5/2001 | Drummond | |
| 6,439,387 | B1 | 8/2002 | Bergman | |
| 6,508,375 | B1 | 1/2003 | Krall | |
| 6,523,713 | B1 | 2/2003 | Helms | |
| 6,637,176 | B1 | 10/2003 | Krall | |
| 6,673,303 | B2 | 1/2004 | White | |
| 6,749,066 | B2 | 6/2004 | Bergman | |
| 6,772,901 | B2 | 8/2004 | Witt | |
| 6,799,692 | B2 | 10/2004 | Teixeira Alvares | |
| 6,857,561 | B2 | 2/2005 | Williams | |
| 6,881,286 | B2 | 4/2005 | Drummond | |
| 6,923,017 | B2 | 8/2005 | Dais | |
| 7,055,713 | B2 | 6/2006 | Rea | |
| 7,086,545 | B2 | 8/2006 | Mannion | |
| 7,134,576 | B2 | 11/2006 | Gringer | |
| 7,267,243 | B2 | 9/2007 | Steg | |
| 7,311,218 | B2 | 12/2007 | Varadarajan | |
| 7,584,866 | B2 | 9/2009 | Selina | |
| 7,694,837 | B2 | 4/2010 | Robertson | |
| 7,703,626 | B2 | 4/2010 | Witt | |
| 7,757,879 | B2 | 7/2010 | Schuetz | |
| 7,870,967 | B2 | 1/2011 | Sawyer | |
| 7,938,293 | B2 | 5/2011 | Gidumal | |
| 7,968,033 | B2 | 6/2011 | Mazzarolo | |
| 8,245,873 | B2 | 8/2012 | Steg | |
| 8,251,239 | B2 | 8/2012 | Yeung | |
| 8,770,427 | B2 | 7/2014 | Longo | |
| 8,991,632 | B2 | 3/2015 | Minnette et al. | |
| 8,998,030 | B2 | 4/2015 | Minnette et al. | |
| 9,032,698 | B2 | 5/2015 | Minnette et al. | |
| 9,067,347 | B2 | 6/2015 | Naber | |
| 2002/0125253 | A1 | 9/2002 | Massey | |
| 2003/0010787 | A1 | 1/2003 | Dalton | |
| 2003/0019878 | A1 | 1/2003 | Scarabelli | |
| 2003/0183636 | A1 | 10/2003 | Shih | |
| 2004/0065698 | A1 | 4/2004 | Braunstein | |
| 2004/0159080 | A1 | 8/2004 | Stewart | |
| 2005/0145632 | A1 | 7/2005 | Cocca | |
| 2005/0167430 | A1 | 8/2005 | Varadarajan | |
| 2006/0278603 | A1 | 12/2006 | Takashima | |
| 2007/0108216 | A1 | 5/2007 | Kurth | |
| 2007/0187352 | A1 | 8/2007 | Kras | |
| 2007/0205196 | A1 | 9/2007 | Burney | |
| 2008/0110896 | A1 | 5/2008 | Westphal | |
| 2008/0264961 | A1 | 10/2008 | Sawyer | |
| 2009/0032534 | A1 | 2/2009 | Luburic | |
| 2009/0032535 | A1 | 2/2009 | Dunwoody | |
| 2009/0113851 | A1 | 5/2009 | Carr | |
| 2009/0302040 | A1 | 12/2009 | Fox | |
| 2010/0059537 | A1 | 3/2010 | Stevens | |
| 2010/0096388 | A1 | 4/2010 | Kobayashi | |
| 2010/0140282 | A1 | 6/2010 | Steg | |
| 2011/0100990 | A1 | 5/2011 | Clodfelter | |
| 2011/0240641 | A1 | 10/2011 | Huels | |
| 2012/0199599 | A1 | 8/2012 | Minnette et al. | |
| 2012/0205375 | A1 | 8/2012 | Hudson | |
| 2012/0234835 | A1 | 9/2012 | Minnette | |
| 2012/0270167 | A1 | 10/2012 | Sato | |
| 2012/0305560 | A1 | 12/2012 | Minnette | |
| 2013/0008904 | A1 | 1/2013 | Minnette | |
| 2013/0032598 | A1 | 2/2013 | Triquet | |
| 2013/0047559 | A1 | 2/2013 | Minnette | |
| 2013/0099414 | A1 | 4/2013 | Minnette | |
| 2013/0104505 | A1 | 5/2013 | Minnette | |
| 2013/0112690 | A1 | 5/2013 | Jongsma | |
| 2013/0153577 | A1 | 6/2013 | Su | |
| 2013/0270143 | A1 | 10/2013 | Muscato | |
| 2013/0292394 | A1 | 11/2013 | Minnette | |
| 2014/0116977 | A1 | 5/2014 | Minnette | |
| 2014/0117025 | A1 | 5/2014 | Minnette | |
| 2014/0215974 | A1 | 8/2014 | Minnette et al. | |
| 2014/0262916 | A1 | 9/2014 | Minnette | |
| 2014/0326735 | A1 | 11/2014 | Minnette | |
| 2015/0203263 | A1 | 7/2015 | Minnette | |
| 2016/0023820 | A1 | 1/2016 | Minnette | |

FOREIGN PATENT DOCUMENTS

| | | | |
|---|---|---|---|
| DE | 2434823 | A1 | 2/1976 |
| EP | 0536137 | B1 | 8/1995 |
| EP | 1930253 | | 2/2011 |
| FR | 1493462 | A | 9/1967 |
| FR | 2692224 | A1 | 12/1993 |
| FR | 2827841 | | 1/2003 |
| FR | 2836460 | A1 | 8/2003 |
| GB | 1408936 | A | 10/1975 |
| JP | 01226503 | A | 9/1989 |
| JP | 02219768 | A | 9/1990 |
| JP | 03289462 | A | 12/1991 |
| WO | 2004103845 | A2 | 12/2004 |

(56) References Cited

FOREIGN PATENT DOCUMENTS

OTHER PUBLICATIONS

Office Action dated Jan. 21, 2016 for U.S. Appl. No. 13/661,704.
International Search Report and Written Opinion dated Dec. 22, 2015, relating to International Application No. PCT/US2015/041784.
European Search Report for Appl. No. 12745363.7 dated Jun. 20, 2014.
International Search Report and Written Opinion dated Apr. 14, 2014, relating to International Application No. PCT/US2013/070273.
International Search Report dated Jun. 20, 2012, relating to International Application No. PCT/US2012/28010.
International Search Report dated May 11, 2012, relating to International Application No. PCT/US2012/023639.
International Search Report dated Sep. 28, 2012, relating to International Application No. PCT/US2012/045965.
Notice of Allowance dated Aug. 21, 2014 for U.S. Appl. No. 13/362,953.
Office action dated Aug. 29, 2013 for U.S. Appl. No. 13/362,953.
Office action dated Feb. 27, 2014 for U.S. Appl. No. 13/362,953.
International Search Report and Written Opinion dated Sep. 4, 2014, relating to International Application No. PCT/US2014/035837.
Office Action dated Jun. 9, 2014 for U.S. Appl. No. 13/544,753.
Notice of Allowance dated Dec. 24, 2014 for U.S. Appl. No. 13/362,953.
Office Action dated Aug. 18, 2015 for U.S. Appl. No. 13/661,704.
Notice of Allowance dated Dec. 2, 2013 for U.S. Appl. No. 13/544,753.
Notice of Allowance dated Jan. 22, 2015 for U.S. Appl. No. 13/544,753.
English summary of Mexican Office Action issued in connection to Mexican Patent Application No. MX/a/2013/008849, mailed Sep. 22, 2015, 4 pages.
Notice of Allowance dated Dec. 18, 2013 for U.S. Appl. No. 13/693,832.
Notice of Allowance dated Jun. 20, 2014 for U.S. Appl. No. 13/693,832.
Notice of Allowance dated Mar. 16, 2015 for U.S. Appl. No. 13/693,832.
Notice of Allowance dated Sep. 30, 2014 for U.S. Appl. No. 13/544,753.
Office Action dated Mar. 28, 2016 for U.S. Appl. No. 14/264,512.
European Search Report for European App. No. 14791028.5 received on Nov. 3, 2016, BP-417 EP || (5723-244308), 8 pages.
Office Action dated Sep. 26, 2016 for U.S. Appl. No. 14/245,237.

* cited by examiner

18Z1
18Z2
18Z3
41BL
403
41
9A
22
22P1
P1
405
41BL
FIRST BEND-LINE
9B
9C 14
24
17W
12
17

PACKAGE WITH PEELABLE CLOSURE

PRIORITY CLAIM

This application claims priority under 35 U.S.C. §119(e) to U.S. Provisional Application Ser. No. 61/930,076, filed Jan. 22, 2014, which is expressly incorporated by reference herein.

BACKGROUND

The present disclosure relates to a package, and particularly to a package including a closure for mounting on a brim of a container. More particularly, the present disclosure relates to a reclosable closure provided with a membrane sheet that mates with a container brim when the closure is mounted on the container brim.

SUMMARY

A package in accordance with the present disclosure includes a closure adapted to mate with a brim of a closure to close a top opening that opens into an interior product-storage region formed in the container. In illustrative embodiments, the closure includes a sheet-support ring adapted to be mated with and mounted on the container brim and a thin membrane sheet bonded permanently to the sheet-support ring and arranged to cover the top opening formed in the container when the sheet-support ring is mounted on the container brim.

In illustrative embodiments, a portion of the thin membrane sheet that is not bonded permanently to the sheet-support ring of the closure is bonded temporarily to a ring-shaped temporary sheet-bonding zone provided along an inner perimeter edge of the container brim at a factory using any suitable means to establish an endless hermetic seal between the closure and the container that extends along the container brim around the top opening formed in the container. While this temporary bond between the membrane sheet of the closure and the brim of the container is broken to break the hermetic seal the first time a consumer removes the closure from the container, the permanent bond established between the sheet-support ring and the membrane sheet is not broken. Therefore, the closure comprising the ring and sheet remains intact and unbroken when the membrane sheet is peeled away from the temporary sheet-bonding zone provided on the container brim the first time a consumer removes the closure from the container brim to open the package. After such a first removal, the closure can be re-mounted on the container brim repeatedly using, for example, a snap-fit connector included in the sheet-support ring to close the package but without establishing any subsequent hermetic seal between the closure and the container.

In illustrative embodiments, the sheet-support ring of the closure includes a central brim-mount platform adapted to overlie and set on a ring-support zone that is provided along an outer perimeter edge of the container brim and is arranged to surround the ring-shaped temporary sheet-bonding zone provided along the inner perimeter edge of the container brim when the closure is coupled to the container brim. The membrane sheet is coupled to the sheet-support ring and to the brim at a factory. A ring-shaped outer portion of the membrane sheet is bonded permanently to a permanent sheet-bonding zone provided on an endless upwardly facing top surface of the sheet-support ring. A ring-shaped middle portion of the membrane sheet is bonded temporarily to a temporary sheet-bonding zone provided on one section of an inner perimeter region of the top surface of the container brim. A central portion of the membrane sheet is arranged to cover a top opening into an interior product-storage region of the container and to be coupled to and surrounded by the ring-shaped middle portion of the membrane sheet. A radially outer portion of the central portion of the membrane sheet is arranged to overlie (without being bonded to) another inner section of the inner perimeter region of the top surface of the container brim.

In illustrative embodiments, the sheet-support ring further includes a sheet-separator lever arm that is coupled to one end of the brim-mount platform of the sheet-support ring for upward pivotable movement relative to the brim-mount platform about a fulcrum provided on a bend line during a closure-removal activity. The sheet-separator lever arm is configured to mate with the membrane sheet to provide leverage as the lever arm is pivoted upwardly from a horizontal initial position associated with a closed position of the closure on the container brim to an angled sheet-lifting position associated with initial peeling separation of the membrane sheet from temporary bonding with the ring-shaped temporary sheet-bonding zone provided along the inner perimeter edge of the container brim.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 7A shows the closure in a closed position on the container brim;

FIG. 7B shows the closure after the first pivotable sheet-separator lever included in the sheet-support ring of the closure has been pivoted by a consumer about the first bend line through an angle of about 15° to cause initial separation of the middle portion of the membrane sheet from the inner perimeter region of the container brim;

FIG. 7C shows the closure after the first pivotable sheet-separator lever included in the sheet-support ring of the closure has been pivoted about the first bend line through an angle of about 30° to cause further separation of the middle portion of the membrane sheet from the inner perimeter region of the container brim;

FIG. 10 shows the closure in a closed position on the container brim wherein the membrane sheet is bonded permanently to the sheet-support ring and temporarily to an inner perimeter region of the container brim;

FIG. 11 shows the closure after the first pivotable sheet-separator lever included in the sheet-support ring of the closure has been pivoted by a consumer about the first bend line through an angle of about 15° to cause initial separation of the middle portion of the membrane sheet from the container brim; and FIG. 12 shows the closure after the first pivotable sheet-separator lever included in the sheet-support ring of the closure has been pivoted by a consumer about the first bend line through an angle of about 30° to cause further separation of the middle portion of the membrane sheet from the container brim.

DETAILED DESCRIPTION

Figure 1:
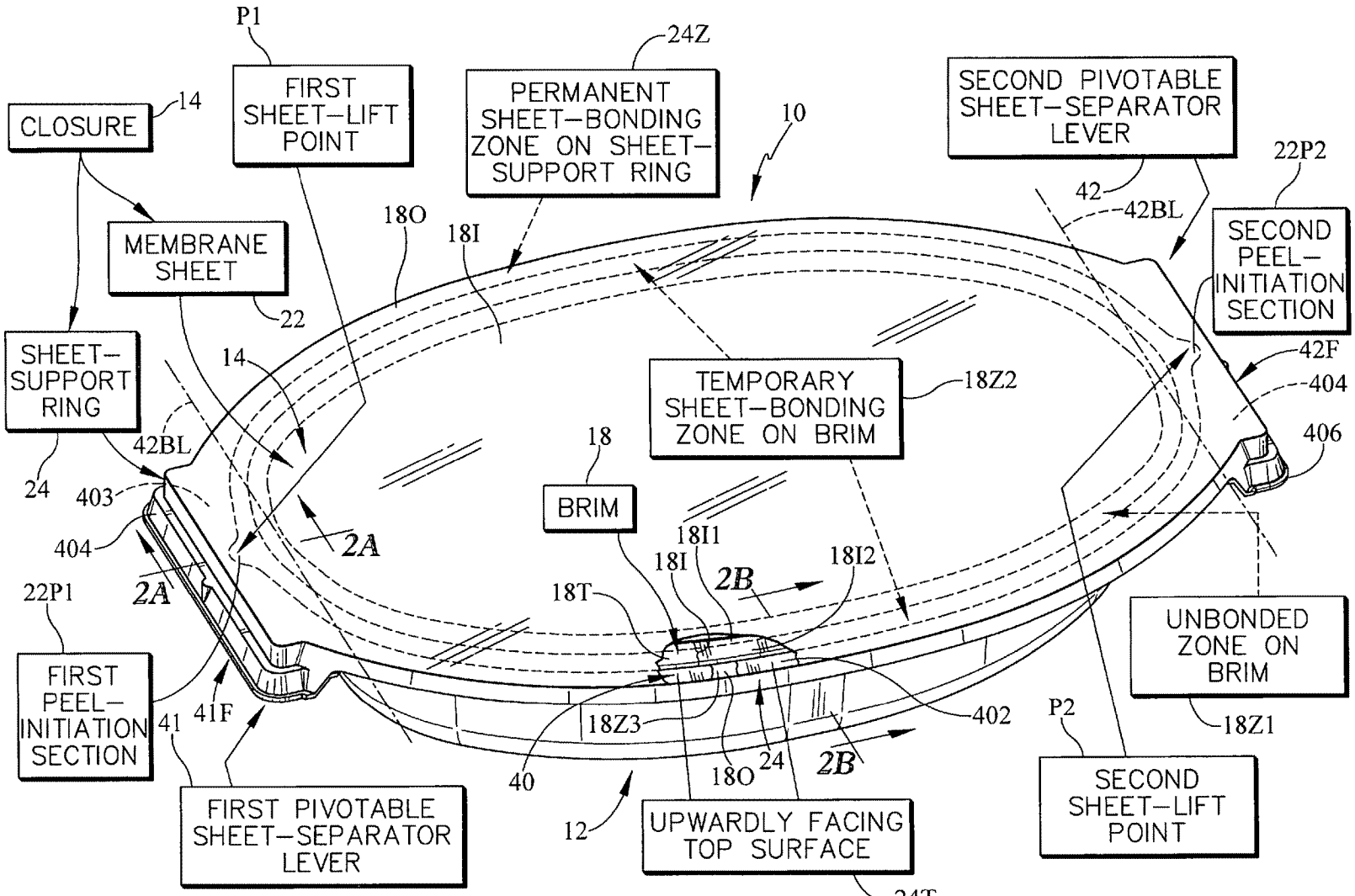
FIG. 1 is a perspective view of a package in accordance with the present disclosure and showing that the package includes a container having a bowl and a brim coupled to a top edge of the bowl and a closure mounted on a brim of the container and configured to include a sheet-support ring and a substantially flat membrane sheet bonded permanently to an upwardly facing top surface of the sheet-support ring, with a portion of the membrane sheet being broken away to reveal an inner portion of the container brim and a portion of the sheet-support ring setting on an outer portion of the container brim, and suggesting that the sheet-support ring includes a pivotable sheet-separator lever arm at each end and a central brim-mount platform arranged to interconnect the two pivotable sheet-separator lever arms and defined by two spaced-apart curved side strips as shown in more detail in FIGS. 4 and 5B and showing the sheet-support ring of the closure at rest on an outer perimeter portion of the container brim and suggesting that a middle portion of the membrane sheet is bonded temporarily to an inner perimeter portion of the container brim and that an outer portion of the membrane sheet is bonded permanently to the sheet-support ring.
Figure 2A:
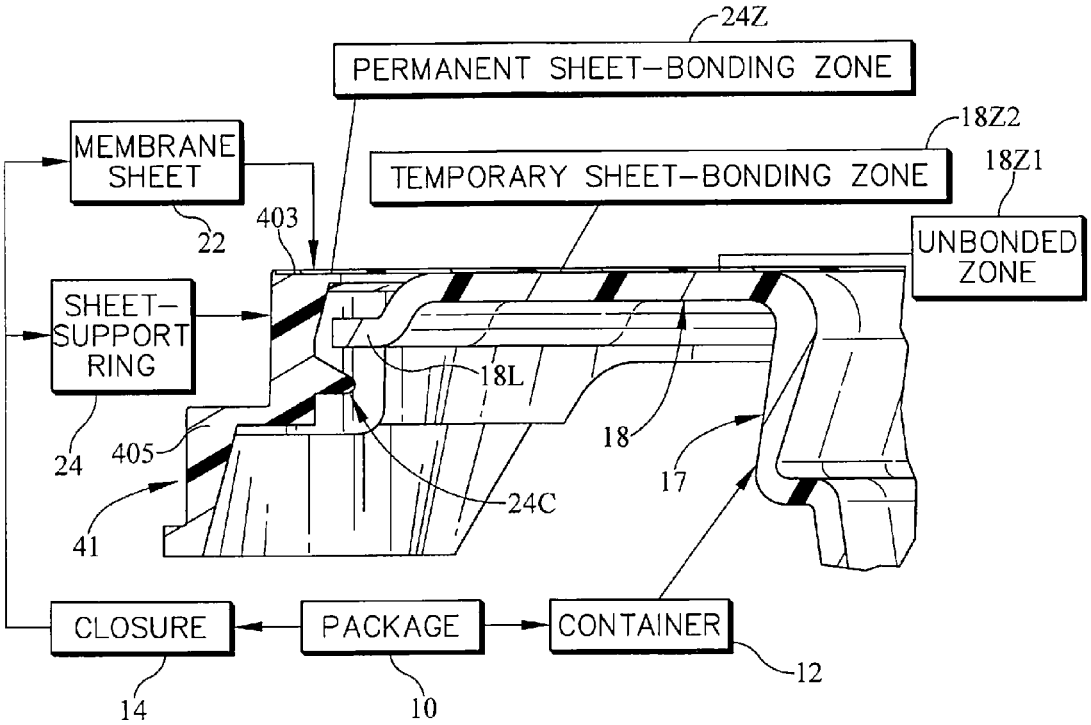
FIG. 2A is an enlarged sectional view of a portion of one end of the package of FIG. 1 taken along line 2A-2A of FIG. 1 showing that the membrane sheet is a thin film that is bonded temporarily to a temporary sheet-bonding zone on an upwardly facing top surface on the container brim and bonded permanently to a permanent sheet-bonding zone of an upwardly facing top surface on one of the pivotable sheet-separator lever arms included in the sheet-support ring.
Figure 2B:
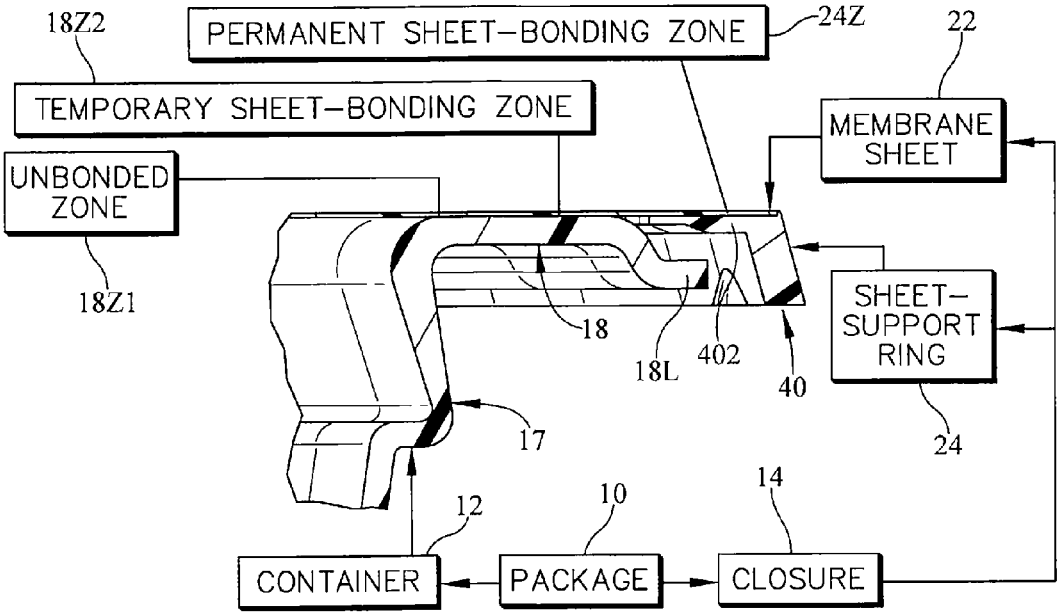
FIG. 2B is an enlarged sectional view of a portion of one side of the package of FIG. 1 taken along line 2B-2B of FIG. 1 showing that the membrane sheet is bonded temporarily to a temporary sheet-bonding zone on an upwardly facing top surface on the container brim and bonded permanently to an upwardly facing top surface on a central brim-mount platform included in the sheet-support ring of the closure.

A package 10 in accordance with the present disclosure includes a container 12 and a closure 14 mounted on container 12 as shown in FIGS. 1, 2A, 2B, and 6. As suggested in FIG. 4, container 12 includes a bowl 17 and a brim 18 and closure 14 includes a membrane sheet 22 made of a thin film and a sheet-support ring 24 configured to mate permanently with membrane sheet 22 in a permanent sheet-bonding zone 24Z provided on an endless upwardly facing top surface 24T of sheet-support ring 24. Sheet-support ring 24 is configured to set on a top wall 18T of brim 18 by mating with a ring-support zone 24Z provided in an outer perimeter region 18O of an endless upwardly facing top surface 18T of brim 18 when closure 14 is mounted on container 12 to close package 10 as suggested in FIGS. 1, 3, and 4.

Figure 3:
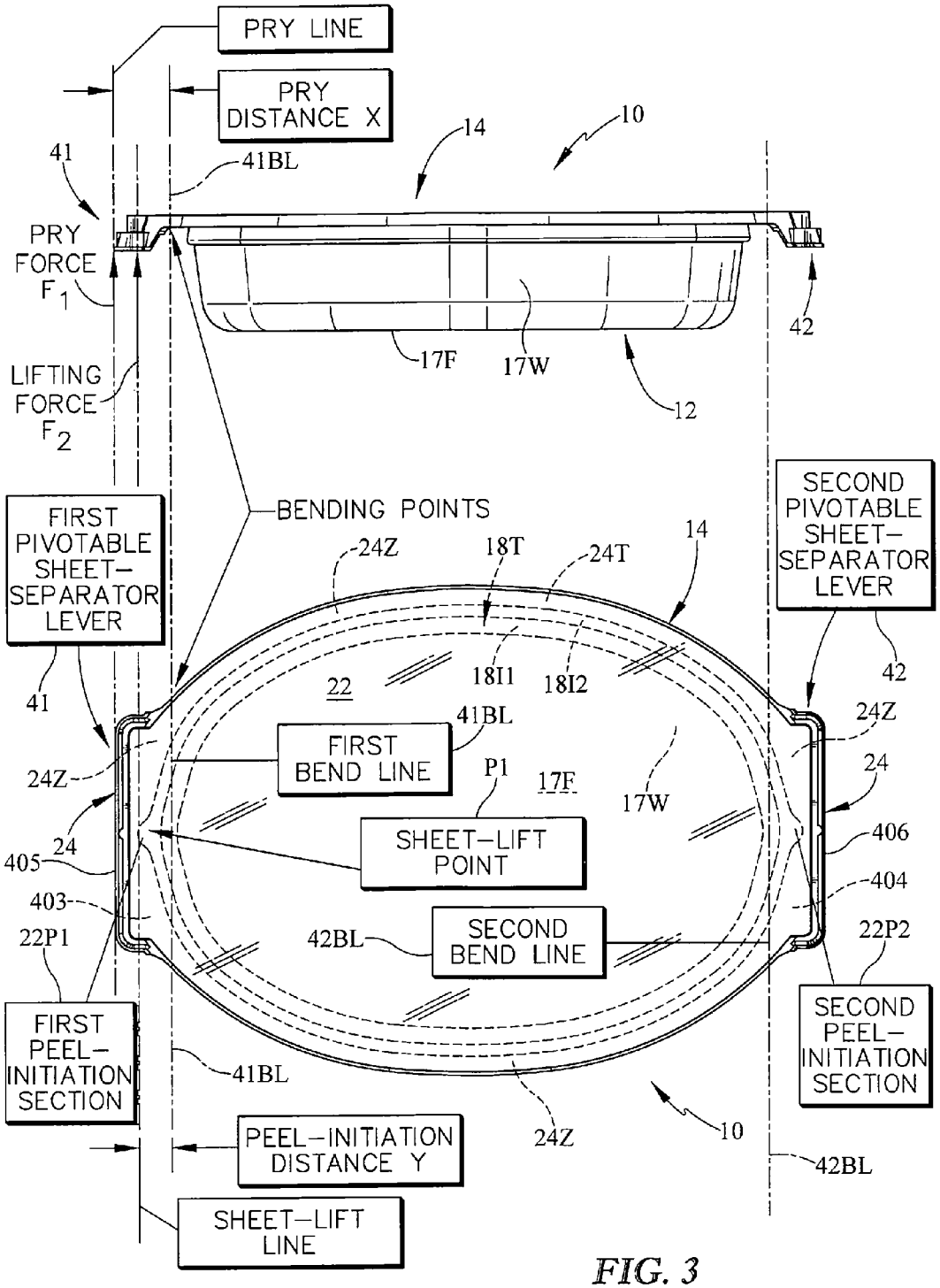
FIG. 3 is a diagrammatic view of aligned side elevation and top views of the package of FIG. 1 showing the location of a first bend line associated with the first pivotable sheet-separator lever arm provided on the left end of the sheet-support ring and the location of a sheet-lift point at the pointed tip of a peel-initiation section of the peelable membrane sheet in the temporary sheet-bonding zone provided on the first pivotable sheet-separator lever arm in a location between a free end of the lever arm (on the left) and the first bend line (on the right) so that a mechanical advantage is created to apply a lifting force to the peelable membrane sheet at the sheet-lift point that is greater than a pry force (F) applied by a consumer to the underside of the free end of the first pivotable sheet-separator lever arm in accordance with the present disclosure to make the hermetically-sealed package easier for consumers to open the first time.
Figure 4:
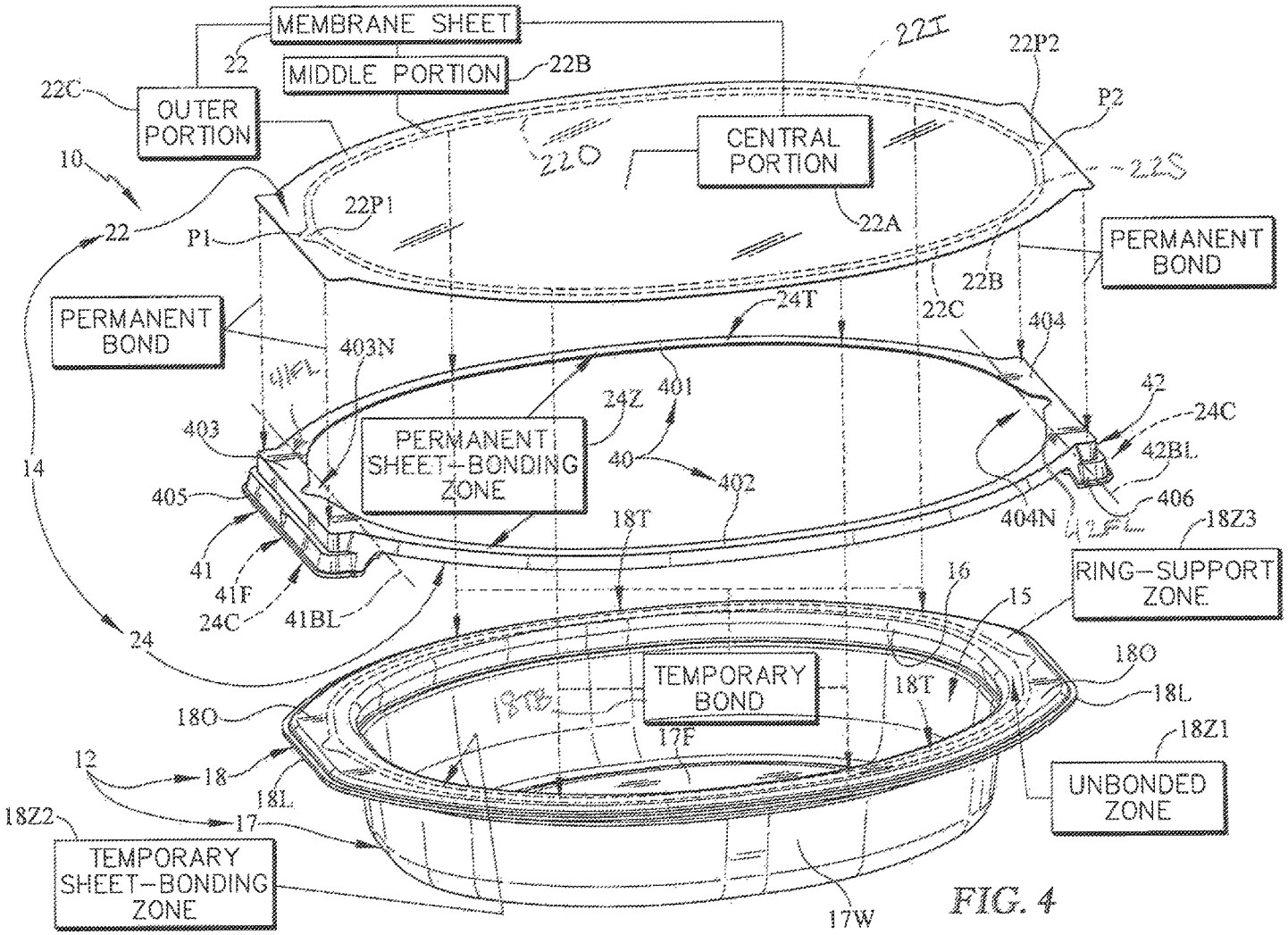
FIG. 4 is an exploded perspective assembly view of the package of FIGS. 1-3 showing (from bottom to top) a container including a bowl and an overhanging brim coupled to the bowl, a sheet-support ring including a central brim-mount platform comprising two spaced-apart curved strips, a first pivotable sheet-separator lever coupled for pivotable movement about a fulcrum at a first bend line to a left end of each of the curved strips defining the central brim-mount platform, and a second pivotable sheet-separator lever coupled for pivotable movement about a fulcrum at a second bend line to a right end of each of the curved strips defining the central brim-mount platform, and a membrane sheet made of a thin film and adapted to be bonded permanently to a permanent sheet-bonding zone provided on an endless upwardly facing top surface of the sheet-support ring of the closure and to be bonded temporarily to a temporary sheet-bonding zone provided on an inner perimeter region of an endless upwardly facing top surface of the container brim.

Membrane sheet 22 of closure 14 is also configured to mate temporarily with an endless inner perimeter region 18I of brim 18 in a temporary sheet-bonding zone 18Z2 to establish an endless hermetic seal between container 12 and closure 14 when sheet-support ring 24 is first mounted on container brim 18 at a package-filling factory to cause closure 14 to close an opening 16 formed in container 12 as suggested in FIGS. 1, 3, and 4. It is within the scope of this disclosure to use any suitable means to provide such a temporary bond and an endless hermetic seal between membrane sheet 22 of closure 14 and brim 18 of container 12 at a package-filling factory. This temporary bond and the hermetic seal is broken the first time a consumer removes closure 14 from container brim 18.

Figure 5A:
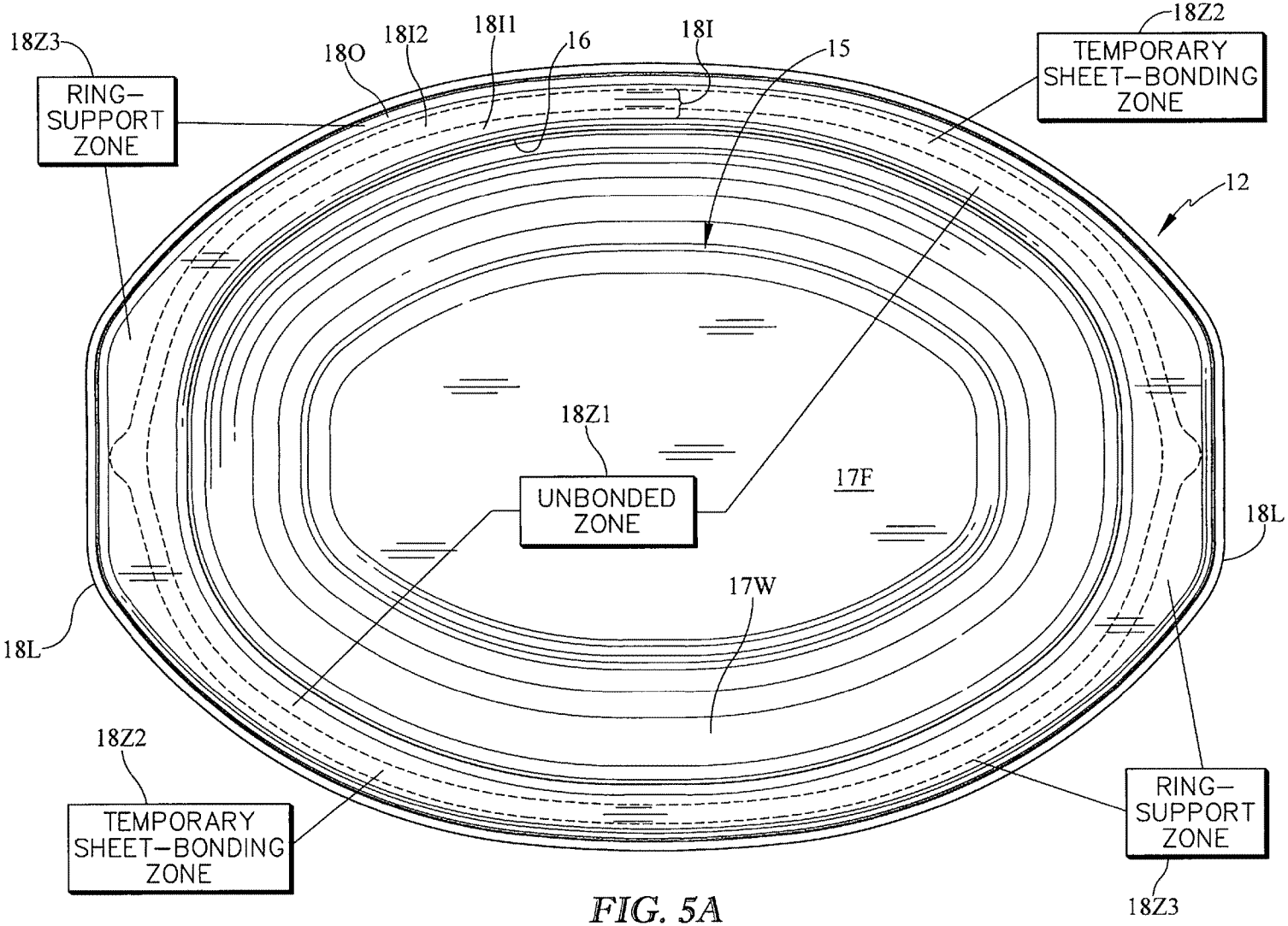
FIG. 5A is a top plan view of the container of FIG. 4 showing that an inner perimeter region portion of the container brim includes an unbonded zone and a temporary sheet-bonding zone surrounding the unbonded zone and showing that an outer perimeter region portion of the container brim includes a ring-support zone surrounding the temporary sheet-bonding zone to provide means for supporting the sheet-support ring on the top surface of the container brim.
Figure 5B:
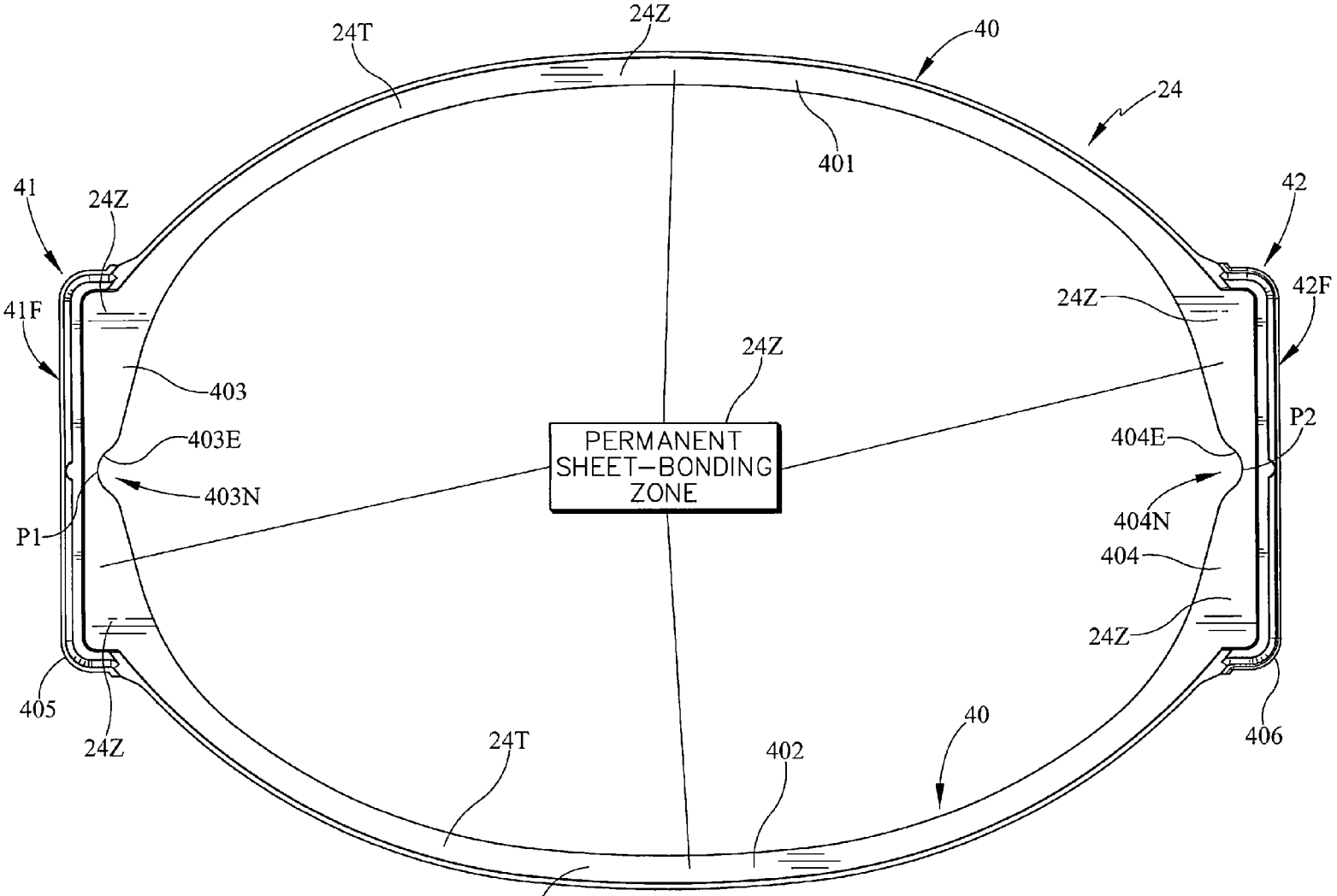
FIG. 5B is a top plan view of the sheet-support ring of FIG. 4 showing that the sheet-support ring includes first and second curved side strips, a first pivotable sheet-separator lever arm coupled to left ends of the curved side strips, and a second pivotable sheet-separator lever arm coupled to right ends of the curved side steps and showing that a permanent sheet-bonding zone is provided on the upwardly facing top surface of the central brim-mount platform of the sheet-support ring.

Sheet-support ring 24 of closure 14 includes a first pivotable sheet-separator lever arm 41, a second pivotable sheet-separator lever arm 42, and a central brim-mount platform 40 lying between interconnecting lever arms 41, 42 as shown, for example, in FIGS. 4 and 5B. Membrane sheet 22 is bonded permanently to a permanent sheet-binding zone 24Z provided on platform 40 and lever arms 41, 42 so that membrane sheet 22 always moves with sheet-support ring 24 relative to container 12.

Figure 9A:
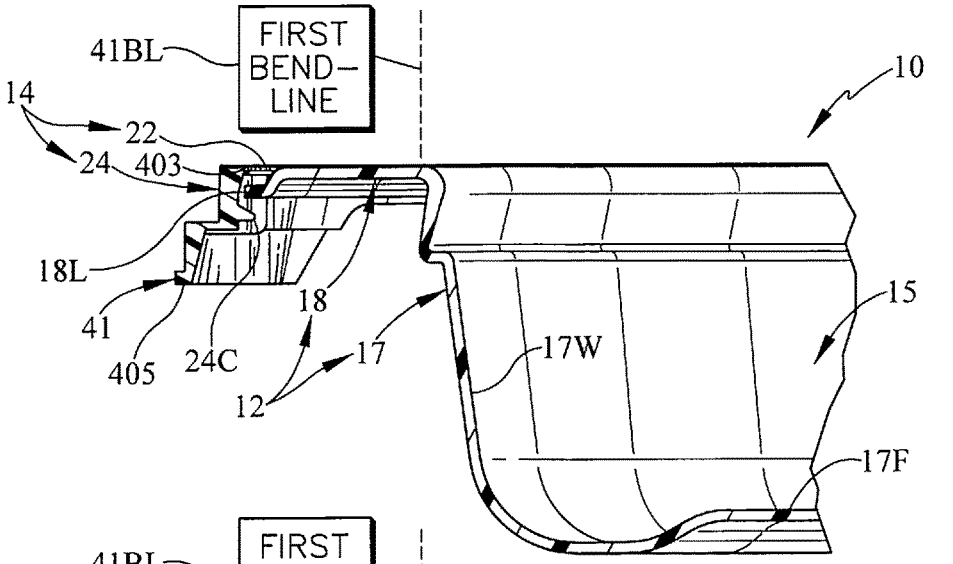
FIG. 9A is an enlarged sectional view taken along line 9A-9A of FIG. 8A.
Figure 9B:
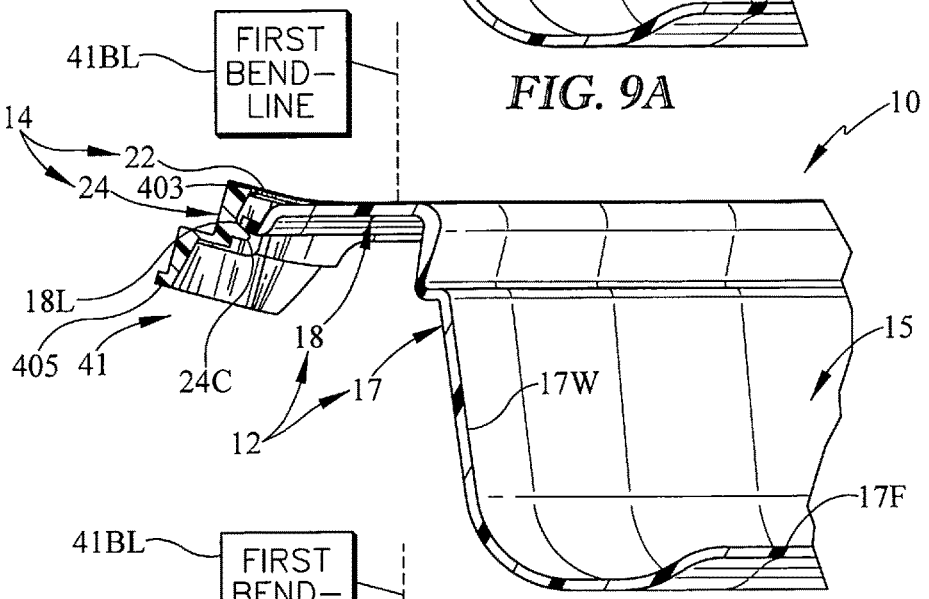
FIG. 9B is an enlarged sectional view taken along line 9B-9B of FIG. 8B.
Figure 10:
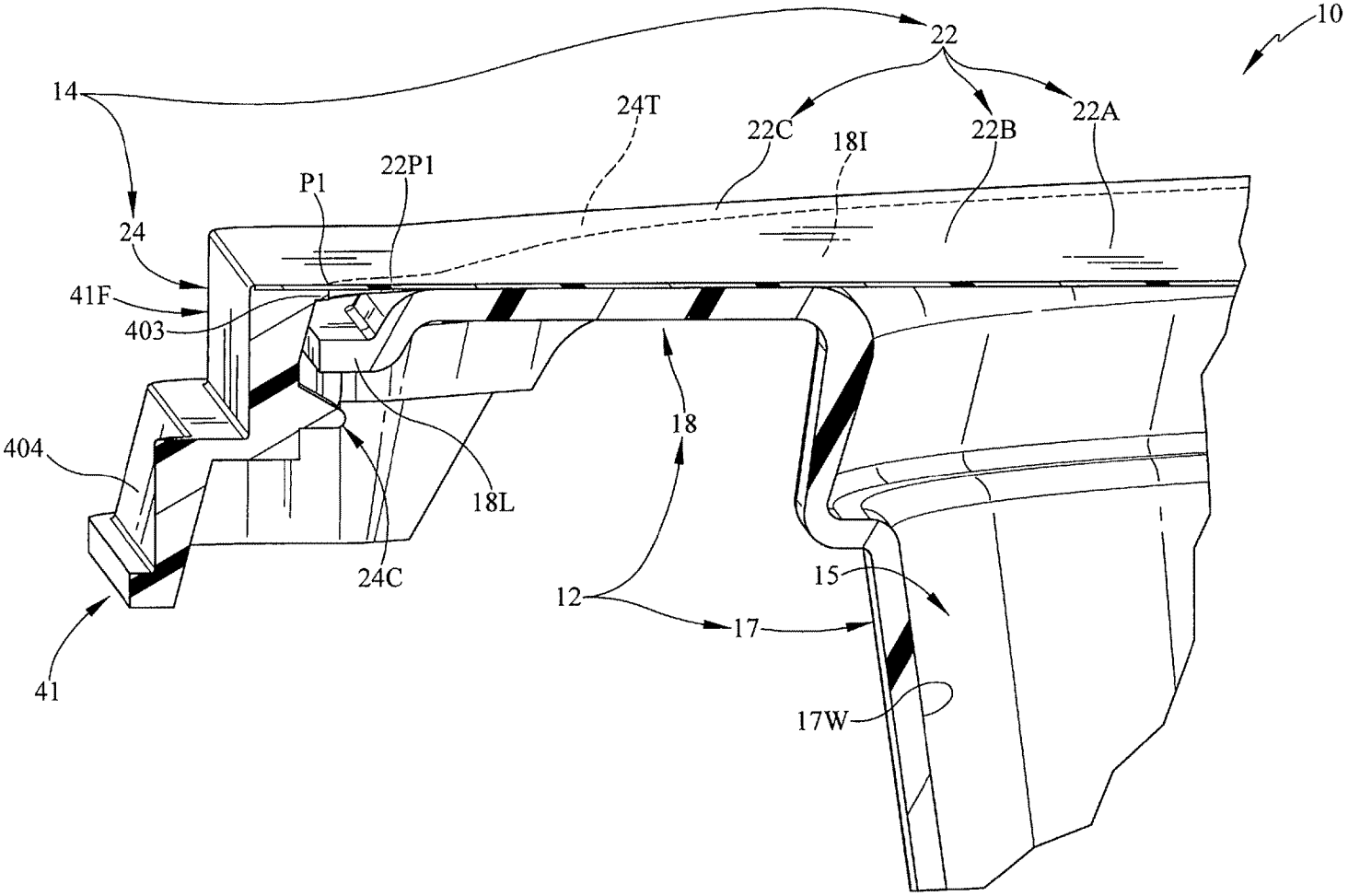
FIGS. 10-12 show a series of sectional perspective views of the left-end portion of the package during a closure-removal sequence that takes place the first time a consumer removes the closure from the container brim.
Figure 11:
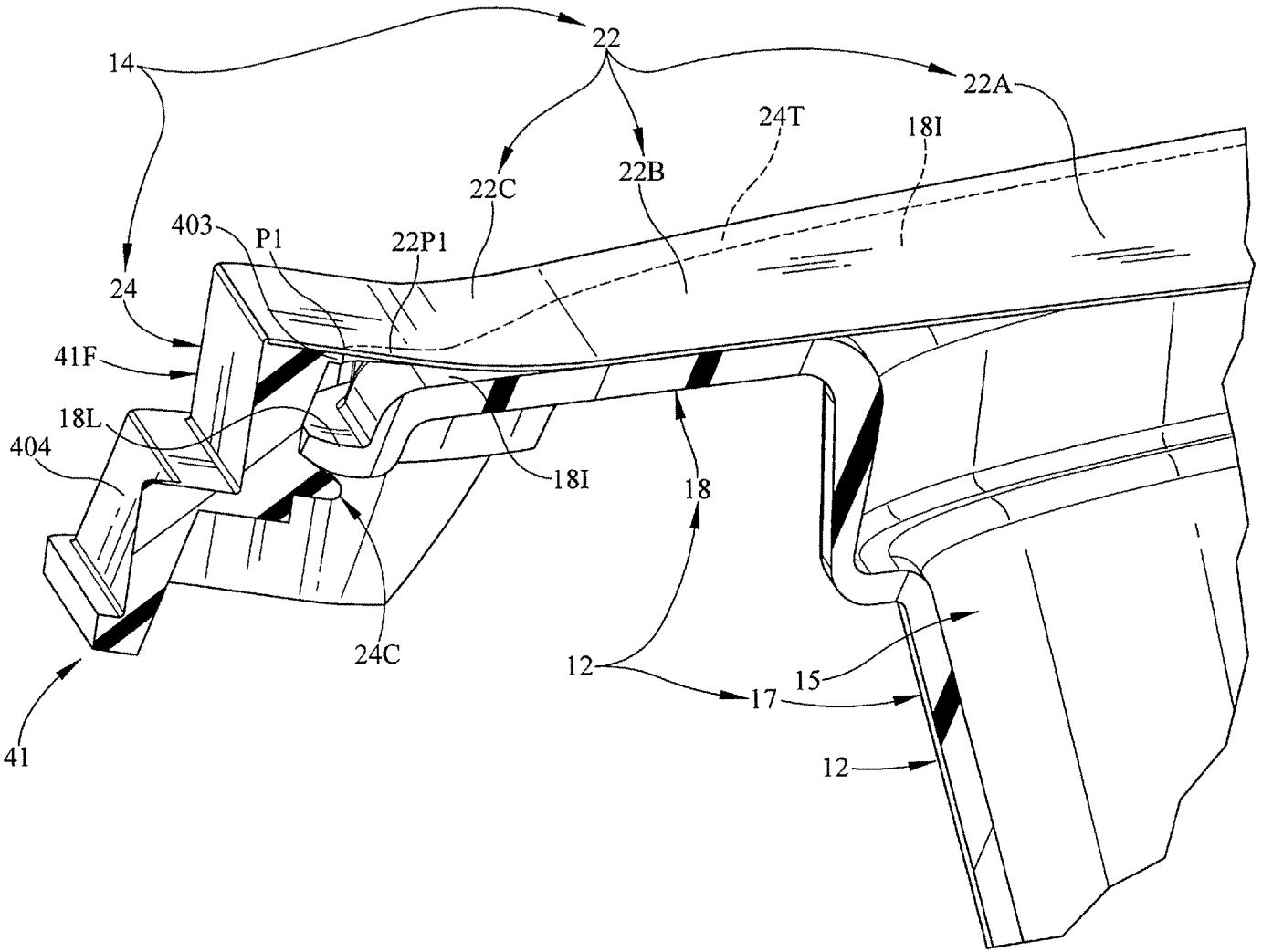

First pivotable sheet-separator lever arm 41 is configured to be pivoted by a consumer about a fulcrum provided on a first bend line 41BL relative to a stationary central brim-mount platform 40 of sheet-support ring 24 as suggested in FIG. 3 during a first-time opening of package 10 from an initial position shown, for example, in FIGS. 9A and 10 to a pivoted peel-initiation position shown, for example, in FIGS. 9B and 11. By pivoting first pivotable sheet-separator lever arm 41 upwardly about a fulcrum on a first bend line 41BL as suggested in FIG. 9B, a consumer can apply a lifting force to membrane sheet at a first sheet-lift point P1 to start to break the temporary hermetic-sealing bond established between a first peel-initiation section 22P 1 of membrane sheet 22 and endless inner perimeter region 18I of container brim 18 the first time package 10 is opened by the customer to access an interior product-storage region 15 formed in container 12. Sheet-lift point P1 is located between a free end 41F of first pivotable sheet-separator lever arm 41 and first bend line 41BL The consumer can then re-mount closure 14 on container 12 by, for example, engaging a snap-fit connector 24C included in sheet-support ring 24 with a perimeter lip 18L of container brim 18 as suggested in FIGS. 2A, 9A, and 10 to reclose package 10 without establishing any hermetic seal between closure 14 and container 12 as often is desired by mating sheet-support ring 24 of closure 14 with the outer perimeter region 18O of container brim 18. While first pivotable sheet-separator lever arm 41 is provided at one end of closure 14, a similar second pivotable sheet-separator lever arm 42 (carrying another snap-fit connector) is provided at an opposite end of closure 14 as suggested in FIGS. 3 and 4. This makes it easy for a consumer to open package 10 from either end 41 or 42.

Package 10 is configured to receive and store products such as food. Container 12 is formed to define interior product-storage region 15 as suggested in FIGS. 4 and 5A. Closure 14 is configured to mount on brim 18 of container 12 to close a top opening 16 formed in container 12 so as to block access to interior product-storage region 15 as suggested in FIGS. 1 and 4.

Container 12 includes a bowl 17 and brim 18 as shown for example, in FIG. 4. Brim 18 is coupled to a top portion of bowl 17 and arranged to extend in radially outward directions away from central opening 16 as shown, for example, in FIG. 4. Container bowl 17 includes a floor 17F and a side wall 17W as suggested in FIGS. 4 and 5A. An upwardly facing top surface 18T of container brim 18 is formed to include an endless inner perimeter region 18I bordering and surrounding top opening 16 and an outer perimeter region 18O surrounding endless inner perimeter region 18I as shown, for example, in FIG. 5A. A radially outer portion of inner perimeter region 18I provides a temporary sheet-bonding zone 18Z2 as suggested in FIGS. 4 and 5A. Outer region 18O of upwardly facing top surface 18T of container brim 18 is arranged to provide a shelf providing a ring-support zone 18Z3 to engage and support an underside of sheet-support ring 24 of closure 14 when closure 14 is mated to container brim 18. Sheet-support ring 24 of closure 14 sets directly on outer perimeter region 18O of container brim 18 in ring-support zone 18Z3 as suggested in FIGS. 4, 5A, 5B, and 6 when closure 14 is mounted on container brim 18.

Substantially flat membrane sheet 22 of closure 14 includes a central portion 22A, ring-shaped middle portion 22B surrounding central portion 22A, and a ring-shaped outer portion 22C surrounding ring-shaped middle portion 22B as shown, for example, in FIG. 4. Central portion 22A is arranged to cover the opening 16 that opens into interior product-storage region 15 formed in bowl 17 of container 12 as suggested in FIGS. 4 and 6. Ring-shaped outer portion 22C is bonded permanently to a permanent sheet-bonding zone 24Z provided on an endless upwardly facing top surface 24T of sheet-support ring 24. Ring-shaped middle portion 22B is bonded temporarily (using an adhesive, weld, or other suitable coupling means) to a temporary sheet-bonding zone 18Z2 provided on an inner perimeter region 18I of an upwardly facing top surface 18T of brim 18 to create a hermetic seal therebetween until closure 14 is removed from brim 18 by a consumer for a first time to access the contents of interior product-storage region 15 formed in container 12.

Inner perimeter portion 18I includes ring-shaped first and second sections 18I1, 18I2 as shown, for example, in FIGS. 1 and 5A. First section 18I1 is ring-shaped and is surrounded by the ring-shaped second section 18I2 as suggested in FIGS. 4 and 6.

Figure 6:
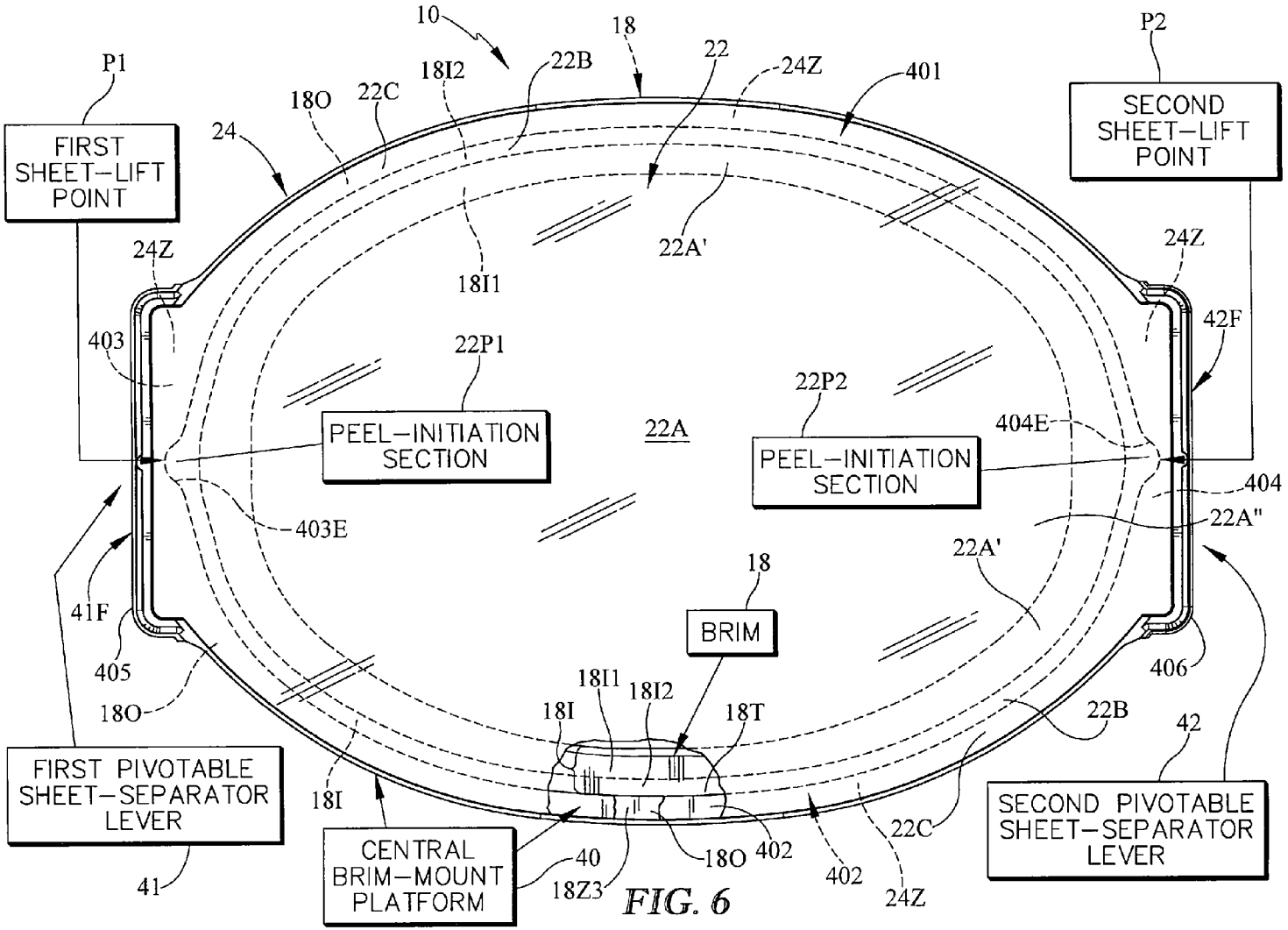
FIG. 6 is a top plan view of the package of FIGS. 1-3 showing the location of a first sheet-lift point (P1) of the peelable membrane sheet of the closure on the left end of the package between the first bend line and a free end of the first pivotable sheet-separator lever arm and a second sheet-lift point (P2) of the peelable membrane sheet of the closure on the right end of the package between a second bend line and a free end of a second pivotable sheet-separator lever arm and showing that the membrane sheet includes a peel-initiation section in communication with each sheet-lift point.
Figures 7A, 7B, 7C, 8A, 8B, 8C:
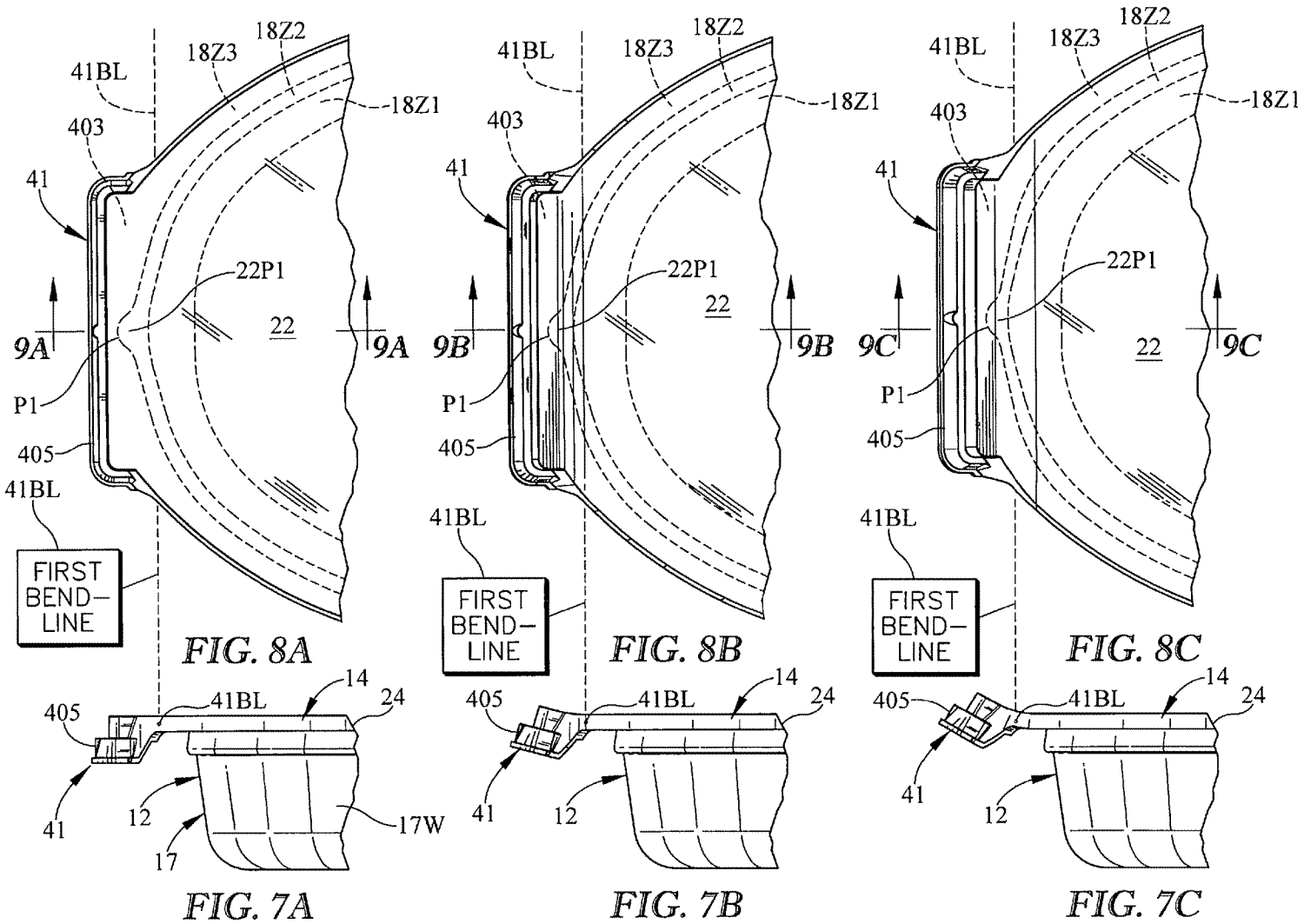
FIGS. 7A-7C show a series of side-elevation views of the left-end portion of the package during a closure-removal sequence that takes place the first time a consumer removes the closure from the container brim.
FIG. 8A is a top plan view of the package portion shown in FIG. 7A wherein the membrane sheet is bonded permanently to the sheet-support ring and temporarily to an inner perimeter region of the container brim.
FIG. 8B is a top plan view of the package portion shown in FIG. 7B.
FIG. 8C is a top plan view of the package portion shown in FIG. 7C.
Figure 12:
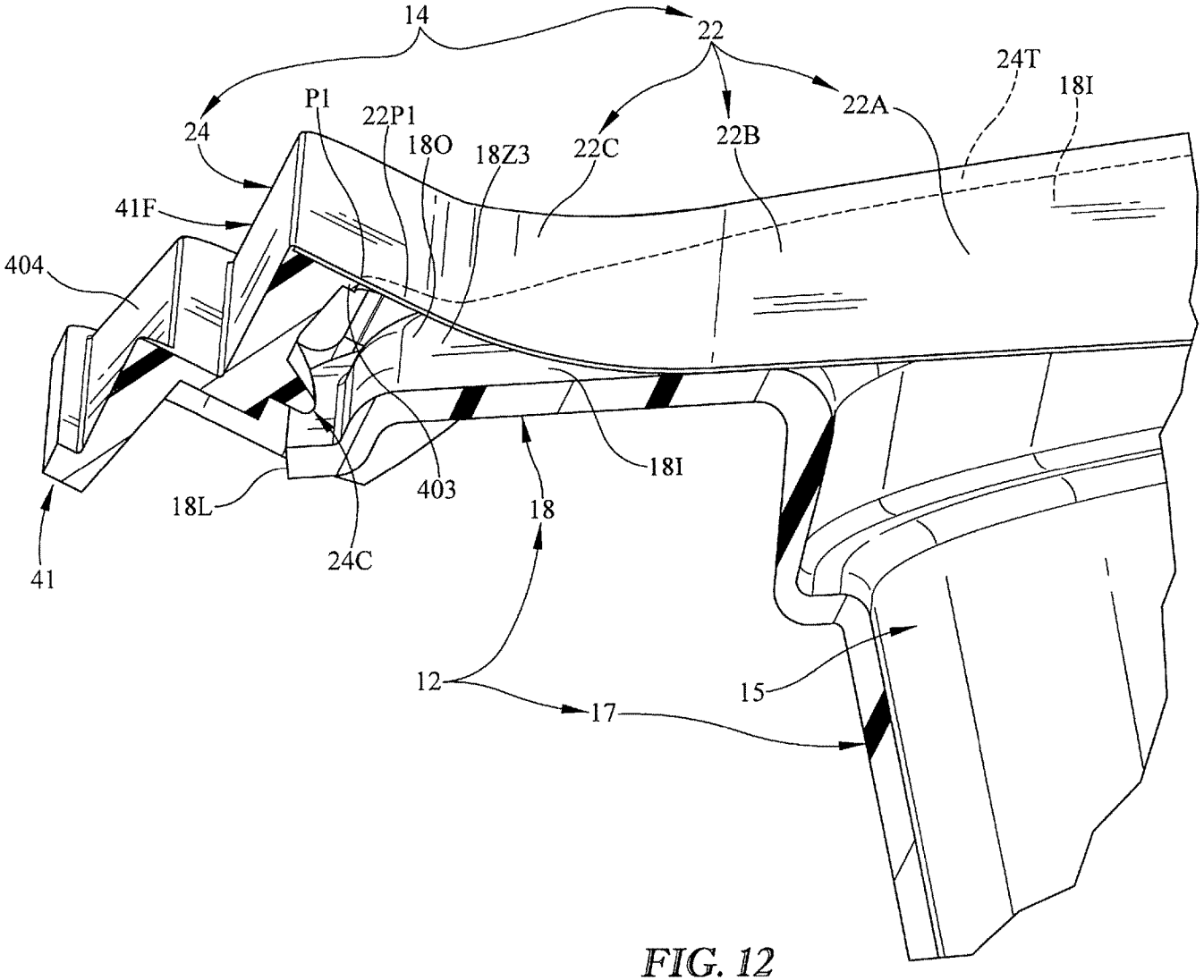

A radially outer portion 22A' of central portion 22A of membrane sheet 22 is not bonded to brim 18 in illustrative embodiments and sets on an unbonded zone 18Z1 provided on first inner section 18I1 of inner perimeter region 18I of container brim 18 as suggested in FIGS. 4 and 6. Second inner section 18I2 of endless inner perimeter region 18I of container brim 18 provides a temporary sheet-bonding zone 18Z2 for membrane sheet 22 as suggested in FIGS. 3, 4, and 5A. Second section 18I2 of inner perimeter region 18I of top surface 18T of container brim 18 is arranged to mate with and to be sealed hermetically to a temporary sheet-bonding zone 18Z2 provided on middle portion 22B of membrane sheet 22 of closure 14 when closure 14 is mated with and sealed to container brim 18 at a package-closing factory. It is the temporary hermetic seal established at the package-closing factory between the middle portion 22B of membrane sheet 22 of closure 14 and second section 18I2 of endless inner perimeter region 18I of container brim 18 that is broken when package 10 is opened the first time by a consumer as suggested, for example, in FIGS. 10-12.

Sheet-support ring 24 of closure 14 includes a central brim-mount platform 40, a first pivotable sheet-separator lever arm 41 coupled to a left end of brim-mount platform 40 for pivotable movement relative to brim-mount platform 40 about a fulcrum 41FL provided on first bend line 41BL, and a second pivotable sheet-separate lever arm 42 coupled to a right end of brim-mount platform 40 for pivotable movement relative to brim-mount platform 40 about a fulcrum 42FL provided on a second bend line 42BL that is arranged to lie in spaced-apart parallel relation to first bend line 41BL as suggested in FIGS. 4, 9A, and 9B.

A snap-fit connector 24C is included in sheet-support ring 24 and coupled to a handgrip included in each of lever arms 41, 42. Snap-fit connector 24C is configured to provide closure retainer means for engaging a lip 18L included in brim 18 to retain sheet-support ring 24 in a mounted container-closing position on container brim 18 as suggested, for example, in FIGS. 4, 9A, and 10.

Central brim-mount platform 40 illustratively includes a curved first strip 401 arranged to mate with an underlying portion of outer region 18O of top surface 18T of container brim 18 and a separate curved second strip 402 arranged to lie in spaced-apart relation to curved first strip 401 and mate with an underlying portion of outer region 18O of top surface 18T of container brim 18 when closure 14 is mounted on container brim 18 as suggested in FIGS. 4, 5B, and 6. A first end of each strip 401, 402 is coupled to first pivotable sheet-separator lever arm 41 as suggested in FIG. 5B. An opposite second end of each strip 401, 402 is coupled to second pivotable sheet separator lever arm 42 as also suggested in FIG. 5B.

First pivotable sheet-separator lever arm 41 includes a handgrip 405 and a first shelf 403 arranged to interconnect first ends of first and second curved strips 401, 402 and coupled to handgrip 405 as shown, for example, in FIGS. 1, 4, and 5B. First shelf 403 is formed to include a peel-initiation notch 403N opening toward interior product-storage region 15 of bowl 17 and toward central portion 22C of membrane sheet 22. First sheet-lift point P1 is located at the apex of peel-initiation notch 403N as suggested in FIG. 5B. An outer edge 403E of first shelf 403 is curved to define a border of peel-initiation notch 403N as shown, for example, in FIG. 5B. This outer edge 403E provides a section-defining frame that extends along a curved outer edge of first peel-initiation section 22P 1 of membrane sheet 22 as suggested in FIGS. 1 and 6.

Second pivotable sheet-separator lever arm 42 includes a handgrip 406 and a second shelf 404 arranged to interconnect second ends of first and second curved strips 401, 402 and coupled to handgrip 406 as shown, for example, in FIGS. 1, 4, and 5B. Second shelf 404 is formed to include a peel-initiation notch 404N opening toward interior product-storage region 15 of bowl 17 and toward central portion 22C of membrane sheet 22. Second sheet-lift point P2 is located at the apex of peel-initiation notch 404N as suggested in FIG. 5B. An outer edge 404E of second shelf 404 is curved to define a border of peel-initiation notch 404N as shown, for example, in FIG. 5B. This outer edge 404E provides a section-defining frame that extends along a curved outer edge of second peel-initiation section 22P2 of membrane sheet 22 as suggested in FIGS. 1 and 6.

Package 10 includes a container 12 and a closure 14 adapted to mate with a brim 18 of container 12 to close a top opening 16 that opens into an interior product-storage region 15 formed in container 12 as suggested in FIGS. 1 and 4. Closure 14 includes a sheet-support ring 24 adapted to be mated with and mounted on the outer region 18O of container brim 18 and a thin membrane sheet 22 bonded permanently to permanent sheet-bonding zone 24Z on sheet-support ring 24 and arranged to cover top opening 16 formed in container 12 when sheet-support ring 24 is mounted on container brim 18.

Sheet-support ring 24 includes a brim-mount platform 40 mated to perimeter side portions of outer portion 22C of membrane sheet 22 and adapted to overlie and set on a ring-support zone 18Z3 provided on outer region 18O of container brim 18 when closure 14 is coupled to container brim 18. Sheet-support ring 24 further includes a sheet-separator lever arm 41 that is coupled to brim-mount platform 40 for pivotable movement relative to brim-mount platform 40 about a fulcrum provided on a bend line 41BL caused by a consumer during a closure-removal activity from an initial position associated with a closed position of the closure on container brim as shown in FIGS. 9A and 10 to a sheet-lifting position associated with initial peeling separation of the middle portion 22B of membrane sheet 22 from temporary bonding with an endless temporary sheet-bonding zone 18Z2 provided on the upwardly facing top surface 18T of the container brim 18 as shown in FIGS. 9B and 10. A package-opening sequence is also shown, for example, in FIGS. 10-12.

Sheet-separator lever arm 41 is arranged to extend outwardly away from container brim 18 and first bend line 41BL to cause a free end of lever arm 41 to lie at a first (pry) distance (X) from first bend line 41BL as suggested in FIG. 3. A first peel-initiation section 22P1 of membrane sheet 22 is bonded temporarily to a temporary sheet-bonding zone 18Z2 provided on a first shelf 403 of the first pivotable sheet-separator lever arm 41 and located between first bend line 41BL and free end 41F of lever arm 41 at a factory when closure 14 is hermetically sealed in a mounted position on container brim 18 to close top opening 16 formed in container 12. Such temporary bonding of first peel-initiation section 22P 1 of membrane sheet 22 to the first shelf 403 of first pivotable sheet-separator lever arm 41 establishes a sheet-lift point P1 at a tip provided on a perimeter edge of first peel-initiation section 22P1 of membrane sheet 22 at a second (peel-initiation) distance (Y) from first bend line 41BL in the temporary sheet-bonding zone 18Z2 provided on the pivotable sheet-separator lever arm 41 of sheet-support ring 24. Second distance (Y) is less than first distance (X) in illustrative embodiments as shown, for example in FIG. 3.

The first pivotable sheet-separator lever arm 41 provides a closure rim structure that can be pivoted about a fulcrum on a first bend line 41BL to create a mechanical advantage to apply an opening force to the sheet-lift point P1 of the peelable membrane sheet 22 of closure 14 to break the temporary bond between the peelable membrane sheet 22 and the first pivotable sheet-separator arm 41 at the peel-initiation section 22P 1 to facilitate closure removal during opening of package 10. Due to such mechanical leverage, the sheet-lifting force ($F_2$) applied to the first peel-initiation section 22P1 of peelable membrane sheet 22 at the sheet-lift point P1 is greater than a pivot-inducing lifting force ($F_1$) applied by a consumer to an underside of the free end 41F of the first pivotable sheet-separator lever arm 41 to cause upward pivoting movement of the first pivotable sheet-separator lever arm 41 about first bend line 41BL during a first step in a process of removing the hermetically sealed closure 14 from container brim 18 the first time package 10 is opened by a consumer. In the illustrated embodiment, the sheet-lifting force ($F_2$) and the pivot-inducing load force ($F_1$) are located on the same side of a fulcrum established on first bend line 41B as suggested in FIG. 3. In such a second-class level mechanism, the sheet-lifting force ($F_2$) is equal to the pivot-inducing load force ($F_2$) multiplied by the first (pry) distance (X) and divided by the second (peel-initiation) distance (Y).

Closure 14 is mounted on a brim 18 of the container 12 and is made of a substantially flat membrane sheet 22 bonded permanently to a permanent sheet-bonding zone 24Z on an upwardly facing top surface 24T of a sheet-support ring 24 as suggested in FIGS. 1, 4, and 6. Sheet-support ring 24 includes a pivotable sheet-separator lever arm 41, 42 at each end and a central brim-mount platform 40 located between lever arms 41, 42. Brim-mount platform 40 is arranged to interconnect the two pivotable sheet-separator lever arms 41, 42 and defined by two spaced-apart curved side strips 401, 402. Membrane sheet 22 is a thin film that is bonded permanently to upwardly facing top surfaces on each of the side strips 401, 402 and each of the pivotable sheet-separator lever arms 41, 42.

Aligned side elevation and top views of package 10 are provided in FIG. 3 to show the location of a first bend line 41BL associated with the first pivotable sheet-separator lever arm 41 provided on the left end of the sheet-support ring 24 and the location of a sheet-lift point P1 at the pointed tip of a peel-initiation section 22P1 of the peelable membrane sheet 22 in a temporary sheet-bonding zone 18Z2 provided on the first pivotable sheet-separator lever arm 41 in a location between a free end 41F of the lever arm 41 (on the left) and the first bend line 41BL (on the right) so that a mechanical advantage is created to apply a greater opening force to the peelable membrane sheet 22 at the sheet-lift point P1 to make the hermetically-sealed package 10 easier for consumers to open the first time. The first sheet-lift point P1 of the peelable membrane sheet 22 of the closure 14 on the left end of package 10 is provided between a first bend line 41BL and a free end 41F of a first pivotable sheet-separator lever arm 41 as suggested in FIGS. 3 and 6. A second sheet-lift point P2 of the peelable membrane sheet 22 of the closure 14 on the right end of package 10 is provided between a second bend line 42BL and a free end 42F of a second pivotable sheet-separator lever arm 42 as shown in FIG. 6.

Membrane sheet 22 is made of a thin film and is adapted to be bonded permanently to a permanent sheet-bonding zone 24Z provided on an upwardly facing top surface 24T of the sheet-support ring 24 and to be bonded temporarily to a temporary sheet-bonding zone 18Z2 provided on an inner portion of an upwardly facing surface 18T of the container brim 18. The permanent sheet-bonding zone 24Z on a top surface 24T of the sheet-support ring 24 is shown, for example, in FIG. 5B. The temporary sheet-bonding zone 18Z2 on a second section 18I2 of an inner portion 18I of the container brim 18 is shown, for example, in FIG. 5A.

The first pivotable sheet-separator lever 41 is in the original closed position as shown, for example, in FIGS. 9A and 10. Membrane sheet 22 of the closure 14 is still hermetically sealed to the container brim 18 in the temporary sheet-bonding zone 18Z2 because the package 10 has never been opened by a consumer since the filled package 10 left the factory. Pivoting movement of first pivotable sheet-separator lever arm 41 about a fulcrum provided on first bend line 41BL relative to central brim-mount platform 40 as suggested in FIG. 9B and in FIGS. 11 and 12 breaks temporary bonds between a peel-initiation section 22P1 of peelable membrane sheet 22 and an upwardly facing top surface 18T on container brim 18 in the temporary sheet-bonding zone 18Z2.

Container 12 includes a bowl 17 formed to include an interior product-storage region 15 and a brim 18 coupled to an upper portion of bowl 17. Brim 18 is arranged to border a top opening 16 into interior product-storage region 15 as suggested in FIG. 4. Brim 18 includes an endless upwardly facing top surface 18T including an endless inner perimeter region 18I bordering and surrounding top opening 16 and providing an endless temporary sheet-bonding zone 18Z2 thereon and an outer perimeter region 18O surrounding endless inner perimeter region 18I and providing a ring-support zone 18Z3 thereon.

Closure 14 is configured to mount on brim 12 in a closed position to close the top opening 16 and block access to interior product-storage region 15 as suggested in FIG. 1. Closure 14 includes a sheet-support ring 24 arranged to engage the ring-support zone 18Z3 on the outer perimeter region 18O of the endless upwardly facing top surface 18T of brim 18 when closure 14 is positioned to lie in the closed position on brim 18 as suggested in FIGS. 1 and 4. Closure 14 further includes a membrane sheet 22 coupled to sheet-support ring 24 to move therewith relative to brim 18 of container 12 when closure 14 is separated from brim 18 to gain access to interior product-storage region 15.

Membrane sheet 22 includes a ring-shaped outer portion 22C bonded permanently to sheet-support ring 24 to form an endless seal therebetween, a central portion 22A surrounded by the ring-shaped outer portion 22C and arranged to cover the top opening 16 into interior product-storage region 15 when closure 14 is positioned to lie in the closed position on brim 18, and a ring-shaped middle portion 22B arranged to interconnect an outer perimeter edge 22O of central portion 22A and an inner perimeter edge 22I of the ring-shaped outer portion 22C as suggested in FIG. 4. Ring-shaped middle portion 22B includes a downwardly facing surface 22S arranged to overlie and confront the endless temporary sheet-bonding zone 18Z2 on the endless inner perimeter region 18I of the endless upwardly facing top surface 18T of brim 18. Package 10 further comprises means for bonding the downwardly facing surface of the ring-shaped middle portion 22B of membrane sheet 22 temporarily 18TB to the temporary sheet-bonding zone 18Z2 on the endless inner perimeter region 18I of the upwardly facing top surface 18T of brim 18 to establish an endless hermetic seal therebetween that remains until closure 14 is removed from brim 18 by a consumer for the first time to gain access to product stored in the interior product-storage region 15.

The endless inner perimeter region 18I of the endless upwardly facing top surface 18T also includes an unbonded zone 18Z1 arranged to lie in spaced-apart relation to the ring-support zone 18Z3 to locate the endless temporary sheet-bonding zone 18Z2 therebetween as suggested in FIGS. 4 and 5A. Central portion 22A of membrane sheet 22 includes a center segment 22K arranged to close the top opening 16 into interior product-storage region 15 and an outer segment 22A' arranged to surround the center segment 22K as shown in FIG. 6. Outer segment 22A' is arranged to interconnect the center segment 22K and the ring-shaped middle portion 22B of membrane sheet 22 and positioned to overlie the unbonded zone 18Z1 established on the endless inner perimeter region 18I of the endless upwardly facing top surface 18T of brim 18.

Figure 9C:
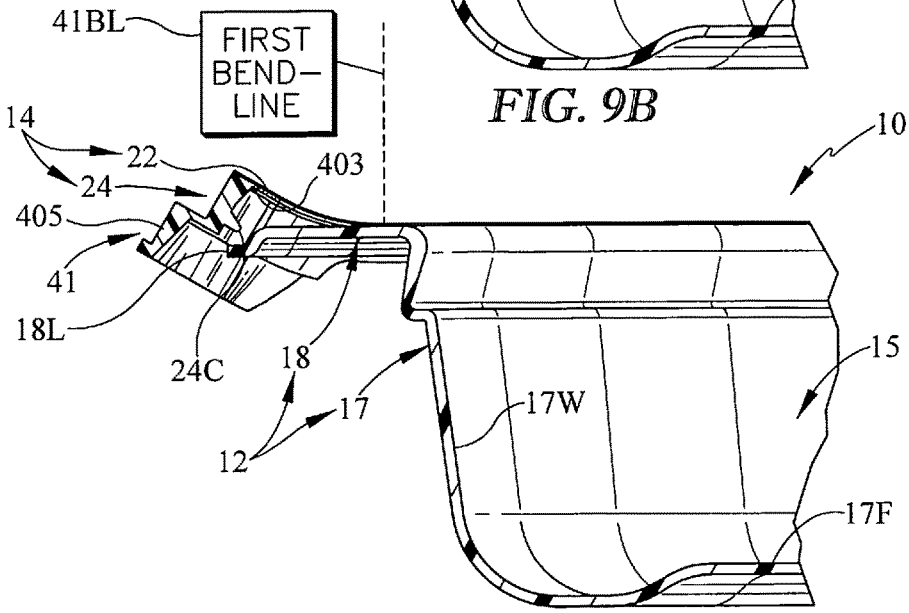
FIG. 9C is an enlarged sectional view taken along line 9C-9C of FIG. 8C.

Sheet-support ring 24 includes a central brim-mount platform 40 and a first pivotable sheet-separator lever arm 41 as suggested in FIG. 4. First pivotable sheet-separator lever arm 41 is coupled to a first end of central brim-mount platform 40 for pivotable movement relative to central brim-mounted platform 40 about a fulcrum provided on a first bend line 41BL upwardly in a clockwise direction away from brim 18 of the container during a closure-removal activity carried out by a consumer from an initial position associated with the closed position of closure 14 on brim 18 of container 12 to a sheet-lifting position associated with initial peeling separation of a first peel-initiation section 22P1 of the ring-shaped middle portion 22B of membrane sheet 22 from the endless temporary bonding zone 18Z2 on the endless inner perimeter portion 18I of the endless upwardly facing top surface 18T of brim 18 as suggested in FIGS. 9A, 9B, and 9C.

Sheet-support ring 24 further includes a second pivotable sheet-separator lever arm 42 as suggested in FIG. 4. Second pivotable sheet-separator arm 42 is coupled to central brim-mount platform 40 to locate the top aperture 16 between the first and second pivotable sheet-separator lever arms 41, 42 for pivotable movement relative to central brim-mount platform 40 about a second bend line 42BL upwardly in a counterclockwise direction away from brim 18 of container 12 during a closure-removal activity carried out by a consumer from an initial position associated with a closed position of closure 14 on brim 18 of container 12 to a sheet-lifting position associated with initial peeling separation of a second peel-initiation section 22P2 of the ring-shaped middle portion 22B of membrane sheet 22 from the endless temporary bonding zone 18Z2 on the endless inner perimeter portion 18I of the endless upwardly facing top surface 18T of brim 18.

Central brim-mount platform 40 of sheet-support ring 24 includes two strips 401, 402 as suggested in FIGS. 4 and 5B. A first strip 401 is arranged to mate with an underlying portion of the outer perimeter region 18O located on one side of brim 18 in the ring-support zone 18Z3 provided thereon. A second strip 402 arranged to lie in spaced-apart relation to first strip 401 to locate the top aperture 16 therebetween and to mate with an underlying portion of the outer perimeter region 18O located on an opposite second side of brim 18 in the ring-support zone 18Z3 provided thereon.

The invention claimed is:

1. A package comprising a container including a bowl having an interior product-storage region and a brim coupled to an upper portion of the bowl and bordering a top opening into the interior product-storage region, the brim including an endless upwardly facing top surface including an endless inner perimeter region bordering and surrounding the top opening and providing an endless temporary sheet-bonding zone thereon and an outer perimeter region surrounding the endless inner perimeter region and providing a ring-support zone thereon, and a closure configured to mount on the brim in a closed position to close the top opening and block access to the interior product-storage region, the closure including a sheet-support ring that engages the ring-support zone on the outer perimeter region of the endless upwardly facing top surface of the brim when the closure is positioned to lie in the closed position on the brim, and the closure further including a membrane sheet coupled to the sheet-support ring to move therewith relative to the brim of the container when the closure is separated from the brim to gain access to the interior product-storage region, wherein the membrane sheet includes a ring-shaped outer portion bonded permanently to the sheet-support ring to form an endless seal therebetween, a central portion surrounded by the ring-shaped outer portion that covers the top opening into the interior product-storage region when the closure is in the closed position on the brim, and a ring-shaped middle portion that interconnects an outer perimeter edge of the central portion and an inner perimeter edge of the ring-shaped outer portion, the ring-shaped middle portion includes a downwardly facing surface that overlies and confronts the endless temporary sheet-bonding zone on the endless inner perimeter region of the endless upwardly facing top surface of the brim, and the package further comprising means for bonding the downwardly facing surface of the ring-shaped middle portion of the membrane sheet temporarily to the temporary sheet-bonding zone on the endless inner perimeter region of the upwardly facing top surface of the brim forming an endless hermetic seal therebetween that remains until the closure is removed from the brim by a consumer for the first time to gain access to product stored in the interior product-storage region, wherein the endless inner perimeter region of the endless upwardly facing top surface also includes an unbonded zone that lies in spaced-apart relation to the ring-support zone to locate the endless temporary sheet-bonding zone therebetween and the central portion of the membrane sheet includes a center segment that closes the top opening into the interior product-storage region and an outer segment that surrounds the center segment and interconnect the center segment and the ring-shaped middle portion of the membrane sheet and positioned to overlie the unbonded zone established on the endless inner perimeter region of the endless upwardly facing top surface of the brim, and wherein the sheet-support ring includes a central brim-mount platform and a first pivotable sheet-separator lever arm coupled to a first end of the central brim-mount platform for pivotable movement relative to the central brim-mounted platform about a fulcrum provided on a first bend line upwardly in a clockwise direction away from the brim of the container during a closure-removal activity carried out by a consumer from an initial position associated with the closed position of the closure on the brim of the container to a sheet-lifting position associated with initial peeling separation of a first peel-initiation section of the ring-shaped middle portion of the membrane sheet from the endless temporary bonding zone on the endless inner perimeter portion of the endless upwardly facing top surface of the brim.

2. The package of claim 1, wherein the sheet-support ring further includes a second pivotable sheet-separator lever arm coupled to the central brim-mount platform to locate the top aperture between the first and second pivotable sheet-separator lever arm for pivotable movement relative to the central brim-mount platform about a second bend line upwardly in a counterclockwise direction away from the brim of the container during a closure-removal activity carried out by a consumer from an initial position associated with a closed position of the closure on the brim of the container to a sheet-lifting position associated with initial peeling separation of a second peel-initiation section of the ring-shaped middle portion of the membrane sheet from the endless temporary bonding zone on the endless inner perimeter portion of the endless upwardly facing top surface of the brim.

3. The package of claim 1, wherein the central brim-mount platform of the sheet-support ring includes a first strip that mates with an underlying portion of the outer perimeter region located on one side of the brim in the ring-support zone provided thereon and a second strip that lies in spaced-apart relation to the first strip to locate the top aperture therebetween and to mate with an underlying portion of the outer perimeter region located on an opposite second side of the brim in the ring-support zone provided thereon.

4. The package of claim 3, wherein the first pivotable sheet-separator lever arm is coupled to one end of each of the first and second strips and the sheet-support ring further includes a second pivotable sheet-separator lever arm coupled to an opposite second end of each of the first and second strips of the central brim-mount platform to locate the top aperture between the first and second pivotable sheet-separator lever arm for pivotable movement relative to the central brim-mount platform about a second bend line upwardly in a counterclockwise direction away from the brim of the container during a closure-removal activity carried out by a consumer from an initial position associated with a closed position of the closure on the brim of the container to a sheet-lifting position initial peeling separation of a second peel-initiation section of the ring-shaped middle portion of the membrane sheet from the endless temporary bonding zone on the endless inner perimeter portion of the endless upwardly facing top surface of the brim.

5. The package of claim 1, wherein the first pivotable sheet-separator lever arm extends outwardly away from the brim and the first bend line to cause a free end of the first pivotable sheet-separator lever arm to lie at a first pry distance from the first bend line, the first peel-initiation section of the ring-shaped middle portion of the membrane sheet initially is bonded temporarily to a portion of the temporary sheet-bonding zone provided on the first pivotable sheet-separator lever arm between the first bend line and the free end of the first pivotable sheet-separator lever arm, the first peel-initiation section of the ring-shaped middle portion of the membrane sheet has a tip that lies between the free end of the first pivotable sheet-separator lever arm and the first bend line to establish a sheet-lift point at the tip at a peel-initiation distance from the first bend line, and the peel-initiation distance is less than the first pry distance to cause a mechanical advantage to be created so that a lifting force applied to the membrane sheet at the sheet-lift point is greater than a pry force applied by a consumer to an underside of the free end of the first pivotable sheet-separator lever arm during first-time removal of the closure from the container.

6. The package of claim 5, wherein the first pivotable sheet-separator lever arm includes a first shelf bonded permanently to the ring-shaped outer portion of the membrane sheet and a handgrip appended to the first shelf, the first shelf includes an outer edge defining a first peel-initiation notch opening toward the central portion of the membrane sheet and having an apex lying in spaced-apart relation to the first bend line and adjacent to the tip of the first peel-initiation section of the middle portion of the membrane sheet to locate the first peel-initiation section between the apex and the first bend line in temporary mating relation with the temporary sheet-bonding zone on the brim.

7. The package of claim 6, wherein the central brim-mount platform of the sheet-support ring includes a first strip that mates with an underlying portion of the outer perimeter region located on one side of the brim in the ring-support zone provided thereon and a second strip that lies in spaced-apart relation to the first strip to locate the top aperture therebetween and to mate with an underlying portion of the outer perimeter region located on an opposite second side of the brim in the ring-support zone provided thereon, and the first shelf is coupled to first ends of each of the first and second strips.

8. A package comprising a container including a bowl having an interior product-storage region and a brim coupled to an upper portion of the bowl, the brim borders a top opening into the interior product-storage region, the brim including an endless upwardly facing top surface, a closure configured to mount on the brim in a closed position to close the top opening and block access to the interior product-storage region, the closure including a sheet-support ring and a membrane sheet coupled to the sheet-support ring to move therewith relative to the brim of the container when the closure is separated from the brim to gain access to the interior product-storage region, wherein the membrane sheet includes a ring-shaped outer portion bonded permanently to the sheet-support ring to form an endless seal therebetween, a central portion surrounded by the ring-shaped outer portion and that covers the top opening into the interior product-storage region when the closure is positioned to lie in the closed position on the brim, and a ring-shaped middle portion that interconnects an outer perimeter edge of the central portion and an inner perimeter edge of the ring-shaped outer portion, the ring-shaped middle portion includes a downwardly facing surface that overlies and confronts an endless temporary sheet-bonding zone on the endless inner perimeter region of the endless upwardly facing top surface of the brim, and the package further comprising means for bonding the downwardly facing surface of the ring-shaped middle portion of the membrane sheet temporarily to a temporary sheet-bonding zone on the endless inner perimeter region of the upwardly facing top surface of the brim to establish an endless hermetic seal therebetween that remains until the closure is removed from the brim by a consumer for the first time to gain access to product stored in the interior product-storage region, and wherein a first pivotable sheet-separator lever arm included in the sheet-support ring extends outwardly away from the brim and the first bend line to cause a free end of the first pivotable sheet-separator lever arm to lie at a first pry distance from the first bend line, a first peel-initiation section of the ring-shaped middle portion of the membrane sheet initially is bonded temporarily to a portion of the temporary sheet-bonding zone provided on the first pivotable sheet-separator lever arm between the first bend line and the free end of the first pivotable sheet-separator lever arm, the first peel-initiation section of the ring-shaped middle portion of the membrane sheet has a tip that lies between the free end of the first pivotable sheet-separator lever arm and the first bend line to establish a sheet-lift point at the tip at a peel-initiation distance from the first bend line, and the peel-initiation distance is less than the first pry distance to cause a mechanical advantage to be created so that a lifting force applied to the membrane sheet at the sheet-lift point is greater than a pry force applied by a consumer to an underside of the free end of the first pivotable sheet-separator lever arm during first-time removal of the closure from the container.

* * * * *